US007651232B2

(12) United States Patent
Baumgartner et al.

(10) Patent No.: US 7,651,232 B2
(45) Date of Patent: Jan. 26, 2010

(54) DOMESTIC APPLIANCE AND SWITCH FOR APPLICATION IN A DOMESTIC APPLIANCE

(75) Inventors: Thomas Baumgartner, Giengen (DE); Jens Christmann, Heidenheim (DE); Wilhelm Sturm, Wittislingen (DE); Ingeborg Sturm, legal representative, Wittislingen (DE)

(73) Assignee: BSH Bosch und Siemens Haugeraete GmbH, Munich (DE)

( * ) Notice: Subject to any disclaimer, the term of this patent is extended or adjusted under 35 U.S.C. 154(b) by 203 days.

(21) Appl. No.: 10/537,131

(22) PCT Filed: Nov. 20, 2003

(86) PCT No.: PCT/EP03/13041

§ 371 (c)(1),
(2), (4) Date: Sep. 26, 2006

(87) PCT Pub. No.: WO2004/051146

PCT Pub. Date: Jun. 17, 2004

(65) Prior Publication Data

US 2007/0090949 A1 Apr. 26, 2007

(30) Foreign Application Priority Data

Dec. 2, 2002 (DE) ..... 102 56 171

(51) Int. Cl.
*F21S 8/00* (2006.01)

(52) U.S. Cl. ..... 362/91; 362/652

(58) Field of Classification Search ..... 362/91, 362/94, 652, 640; 200/293, 296, 310–314, 200/341, 61.67, 510, 61.62–61.63, 61.7; 340/815.48; 315/84; 134/113, 57 D, 56 D, 134/58 D See application file for complete search history.

(56) References Cited

U.S. PATENT DOCUMENTS

| | | | | |
|---|---|---|---|---|
| 3,619,592 | A * | 11/1971 | Lamb, Jr. | 362/91 |
| 5,847,343 | A * | 12/1998 | Kim | 200/61.76 |
| 5,870,787 | A | 2/1999 | Choi | |
| 6,295,004 | B1 | 9/2001 | Burnett | |

FOREIGN PATENT DOCUMENTS

| | | | |
|---|---|---|---|
| DE | 40 19 411 | A1 | 12/1991 |
| EP | 0160206 | A2 * | 6/1985 |
| EP | 0157037 | A2 * | 9/1985 |
| EP | 0 506 633 | A2 | 9/1992 |
| GB | 1 476 724 | | 6/1977 |

OTHER PUBLICATIONS

International Search Report for PCT/EP2003/013041, Apr. 3, 2004.

* cited by examiner

*Primary Examiner*—Sharon E Payne
(74) *Attorney, Agent, or Firm*—James E. Howard; Andre Pallapies

(57) ABSTRACT

A dishwashing machine is provided having a door pivotable around the horizontal axis thereof and a switch arranged on the door. The switch is operable to generate an electric signal when a predetermined pivoting angle of the door is reached as the door is being opened. The dishwasher also includes a light source that illuminates the interior of the dishwashing machine, the light source being disposed in the interior of the dishwashing machine and being operably connected to the switch such that the light source is activated into an illuminated condition in response to the receipt of the electrical signal from the switch.

10 Claims, 2 Drawing Sheets

DOMESTIC APPLIANCE AND SWITCH FOR APPLICATION IN A DOMESTIC APPLIANCE

The invention relates to a domestic appliance with a door mounted to pivot on a horizontal axis and a switch for use in such a domestic appliance.

Dishwashing machines or cookers provided with a door which is arranged in such a way that it is pivotable around the horizontal axis thereof and which is opened for loading and unloading are known. This pivotally mounted door is usually embodied in a dishwashing machine such that it is opened so far for loading and unloading that the inner side of the door facing the treatment compartment, the washing container, is aligned substantially horizontally so that a lower crockery basket can be received. For this purpose the lower crockery basket advantageously has rollers or wheel devices on its underside which are guided over special rails or beads in the inside of the door. After the door has been completely opened out, i.e., until the door is aligned substantially horizontally and the lower crockery basket has rolled out, this can be loaded and unloaded relatively conveniently. Such a widely opened door represents a potential hazard, especially if a dishwashing machine thus opened is located in a dark room, for example a kitchen.

DE 198 04 894 A1 discloses a switch which can be used in domestic appliances, for example in dishwashing machines and can be arranged on the domestic appliance such that when the door is open, a light source is switched on in the interior of the domestic appliance and goes out again when the door closes. A trip cam associated with a spring element is provided to actuate the switch and the switch has a control stem which is actuated by the spring element. This switch can only distinguish between the two states "door closed" and "door open". It is disadvantageous that an intermediate state such as, for example "door slightly open" is not identified. However, it would be desirable to identify this intermediate state in front-loading dishwashing machines to comply with the different habits of the user and also with the wish to indicate a potential hazard.

It is the object of the invention to provide a domestic appliance of the type specified initially which represents no increased potential hazard even when the door is opened wide and to provide a switch which also "recognises" intermediate states of the door position.

This object is solved by the domestic appliance according to the invention having the features of claim 1 and by a switch according to the invention having the features of the further independent claim. Advantageous embodiments of the invention are characterised in the dependent claims.

The inventive arrangement of the domestic appliance according to the invention provided with a door which is arranged in such a way that it is pivotable around the horizontal axis thereof, has a switch arranged on the door and is embodied in such a way that it switches on a light source in the interior of the domestic appliance when a certain pivoting angle of the opened door is reached.

The switch according to the invention has a retractable button which is actuated by means of a weight which is always self-aligning with the vertical. From a certain inclination of the door said switches closes a circuit to switch on a light source in the interior of the domestic appliance.

During daily use of a household appliance provided with a door which is arranged in such a way that it is pivotable around the horizontal axis thereof, said appliance is used differently according to the personal habits of the user. Whereas some users always keep the pivotally mounted door closed and merely open it for loading and unloading, other people only lock the pivotally mounted door during the program run and leave the door ajar and unlocked for the rest of the time. Even if the mechanical locking installation and the door seals of present-day household appliances are designed for lifetime usage, some people avoid continuously locking the door if no program is running. Another reason for not locking can be that the door can be opened more quickly for loading if it is not locked. Another reason for not locking may be that odours can escape. Also moisture can easily escape from the interior of the household appliance without the door being pivoted out so far that it represents a potential hazard.

With the switch according to the invention in a domestic appliance provided with a door which is arranged in such a way that it is pivotable around the horizontal axis thereof, it is possible to switch on a light source in the interior of the domestic appliance which illuminates the interior of said domestic appliance only when a certain pivoting angle of the opened door is reached. Thus, with the switch according to the invention it is also possible to leave the door ajar and unlocked, according to the personal habits of the user, without a light source being switched on.

A domestic appliance according to the invention fitted with the switch according to the invention thus has the advantage that a light source is always switched on when the door is pivoted out so far that it can be a potential hazard but no light is switched on if the pivoting angle of the door is small. Another advantage of the present invention is that the user of the domestic appliance, when entering the unlit kitchen carrying items to be placed in the domestic appliance for example, need not switch on the room light expressly for this purpose for loading the domestic appliance but merely after putting down the items and opening the domestic appliance, has sufficient light to be able to load the domestic appliance.

In an advantageous embodiment of the switch according to the invention a strip-like bar is arranged over the retractable button such that from an inclination which can be determined, the weight provided at its end presses down the retractable button as a result of gravity and thus closes a circuit which switches on a light source. If the pivot angle of the opened door is reduced, the reaction force of the strip-like bar on the button exposed to spring pressure is reduced accordingly. As soon as the spring pressure in the button is greater than the reaction force of the strip-like bar, the spring presses the button away from the contact point and the circuit to the light source is interrupted. The angle of inclination from which the switch function is triggered can be calculated from simple physical relationships whose calculation parameters are the spring strength in the button, the mass of the weight and the geometrical profile of the connecting means. The angle of inclination can be adjusted by varying these quantities.

According to an advantageous embodiment of the invention, an unstably shaped connecting means is guided through an eye-like recess in the retractable button, said means having a weight provided at its end which presses down the retractable button as a result of gravity. In this case, the unstably shaped connecting means can be a wire and/or plastic.

The invention provides a domestic appliance with a door mounted to pivot on a horizontal axis which presents no increased potential hazard even when the door is wide open and also provides a switch which "recognises" intermediate states of the door position.

The invention is explained subsequently with reference to a preferred embodiment shown in the drawings. In the figures.

Figure 1:
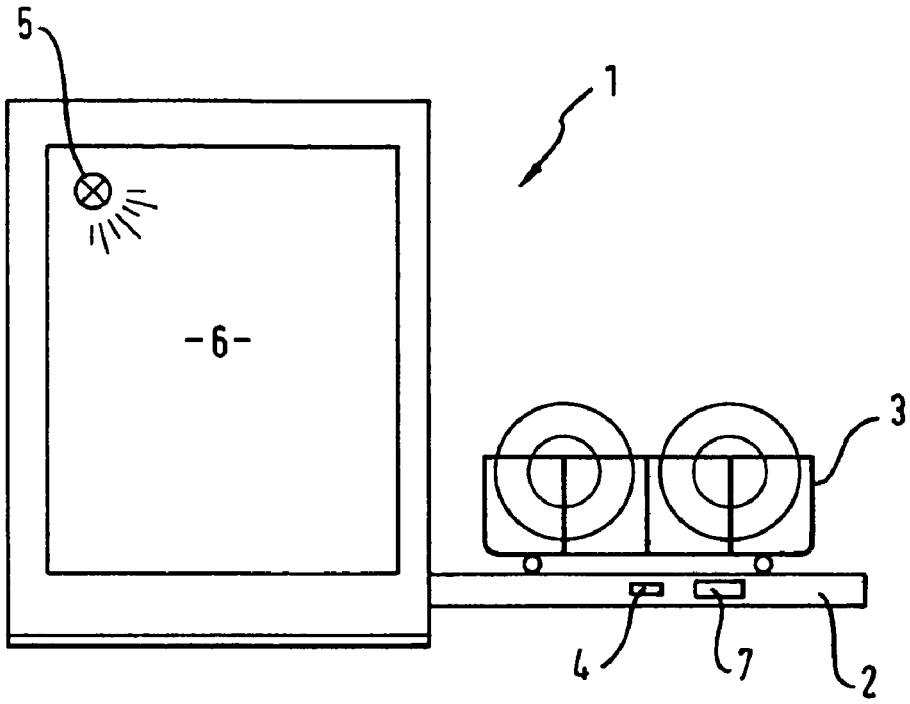
FIG. 1 is a domestic appliance according to the invention with the door pivoted out horizontally.

FIG. 1 shows a domestic appliance according to the invention, in this exemplary embodiment a dishwashing machine 1, where a crockery basket 3 is arranged on its door 2 which is mounted in such a way that it is pivotable about a horizontal axis not shown. In this state a switch 4 is activated and has switched on a light source 5 arranged in the interior 6 of the dishwashing machine 1. The switch 4 can be connected to a control unit 7 which for its part is connected to the light source 5 and controls its state. The control unit 7 is more appropriately connected to an electronic program control, in the exemplary embodiment shown, a program controller connected to the dishwashing machine 1.

Figure 2:
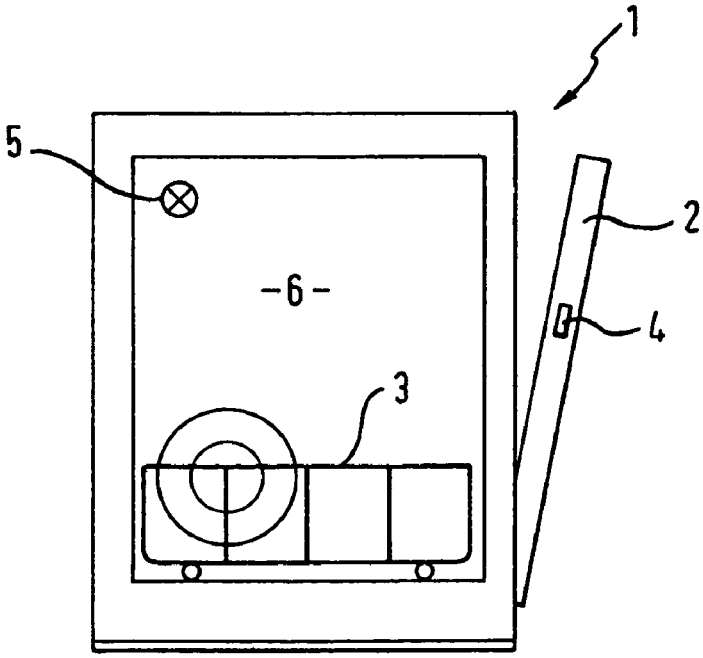
FIG. 2 is a domestic appliance according to the invention with the door unlocked and ajar.

FIG. 2 shows the dishwashing machine 1 with its pivotable door 2 inclined such that the switch 4 is not activated. In this position steam can easily escape from the interior of the dishwashing machine without the door 2 being pivoted out so far, however, that it represents a potential hazard.

Figure 3:
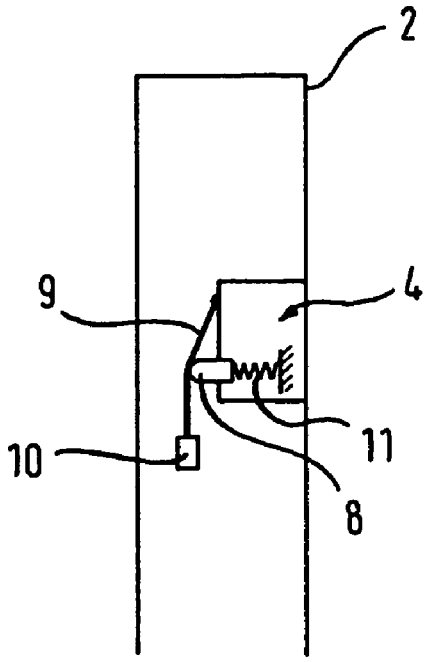
FIG. 3 is a schematic diagram of the switch according to the invention in a first position and FIG. 4 is a schematic diagram of the switch according to the invention in a second position.

FIG. 3 shows a schematic diagram of the switch 4 according to the invention comprising a button 8 which is prestressed by means of a spring 11. In this first position the weight 10 is suspended on an unstably shaped connecting means 9, for example a wire or plastic strip. The connecting means can also be embodied as stably shaped in which case, however, the relative movement of the connecting means with respect to the button must be taken into account. As a result of gravity, the weight 10 exerts a certain force on the button 8 but in this state the spring force is greater and the switch 4 stays in the "off" position.

Figure 4:
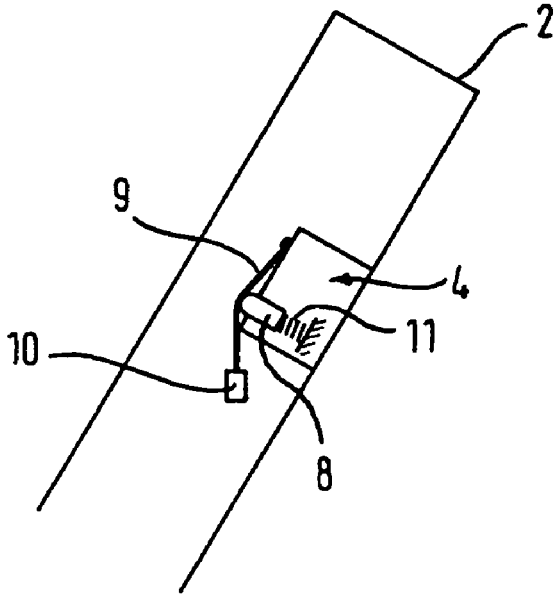

FIG. 4 shows a schematic diagram of the switch 4 according to the invention where the weight 10 presses down the button 8 by means of the unstably shaped connecting means 9 and thus closes a circuit. As a result of the inclination of the door, the force component of the connecting means 9 on the button 8 is increased so that the reaction force is now greater than the spring force and the switch 4 goes over to the "on" position.

The pivot angle is determined at the factory so that the switch 4 located in the door only comes on when the deflection is more than 10°, for example. However, it may also be appropriate to switch on the switch 4 at a smaller pivot angle.

The switch 4 is advantageously arranged in the door 2 so that no sealing problems with respect to the washing container are to be expected.

In a further embodiment of the present invention which is not shown, it is advantageous, in addition to switching on the light source 5, to generate an acoustic signal which sounds after the pivotally mounted door 2 has remained open for a certain time, for example after 30 minutes, as a reminder that the door 2 is open.

With the switch 4 according to the invention in a domestic appliance with a door 2 mounted to pivot on a horizontal axis, it is possible for a light source 5 to be switched on in the interior 6 of the domestic appliance, which illuminates the interior of the domestic appliance, only when a certain pivoting angle of the opened door is reached. Thus, with the domestic appliance it is also possible to leave the door 2 ajar, according to the personal habits of the user, without a light source 5 being switched on.

A domestic appliance according to the invention fitted with the switch 4 according to the invention thus has the advantage that a light source 5 is always switched on when the door 2 is pivoted out so far that it can represent a potential source of danger but when the pivoting angle of the door 2 is small, no light is switched on. Also the user of the domestic appliance, when entering the unlit kitchen carrying items to be placed in the domestic appliance for example, need not switch on the room light expressly for this purpose for loading the domestic appliance but merely after putting down the items and opening the domestic appliance, has sufficient light to be able to load the household domestic.

The invention provides a domestic appliance provided with a door 2 which is arranged in such a way that it is pivotable around a horizontal axis thereof, which also presents no increased potential hazard when the door is wide open, and further provides a switch 4 which also "recognises" intermediate states of the door position.

The invention claimed is:

1. A dishwashing machine, comprising:

a plurality of generally upstanding, interconnected interior walls forming a washing chamber;

a door pivotable around a horizontal axis thereof;

a door seal disposed intermediate the interior walls and the door to form a watertight washing compartment when the door is closed against the door seal;

a switch arranged on the door, the switch being operable to generate an electric signal when a predetermined pivoting angle of the door is reached as the door is being opened; and a light source configured for illuminating the interior of the washing chamber of the dishwashing machine, the light source being mounted to one of the interior walls, thereby being disposed in the interior of the dishwashing machine interiorly of the door seal and not disposed on the door, the light source and being operably connected to the switch such that the light source is activated into an illuminated condition to illuminate the interior of the washing chamber of the dishwashing machine from within the washing chamber in response to the receipt of the electrical signal from the switch.

2. The dishwashing machine according to claim 1, wherein the switch includes a retractable button movable against a biasing means toward an actuation position in which the retractable button closes an electrical circuit to thereby energize the light source and a weight arranged relative to the retractable button such that the weight is operable under the influence of gravity to increasingly urge the retractable button against the biasing means toward the actuation position as the door is increasingly pivoted away from a vertical position.

3. The dishwashing machine according to claim 2, and further comprising a strip-like bar having an end at which the weight is secured, the strip-like bar being arranged over the retractable button such that the weight presses the retractable button against the biasing means toward the actuation position as a result of gravity.

4. The dishwashing machine according to claim 2, wherein the switch includes an unstably shaped connecting means guided through an eye-like recess in the retractable button, the weight being secured to an end of the unstably shaped connecting means such that the weight presses the retractable button against the biasing means toward the actuation position as a result of gravity.

5. The dishwashing machine according to claim 4, wherein the unstably shaped connecting means is comprised of a selected one of wire, plastic, and wire and plastic.

6. A switch for mounting on a door of a dishwashing machine, the door of the dishwashing machine being pivotable around a horizontal axis thereof and the dishwashing machine having a light source, the switch comprising:

means for generating an electric signal when a predetermined pivoting angle of the door is reached as the door is being opened; the switch being operably connected to the light source such that the light source is activated into an illuminated condition in response to the receipt of the electrical signal from the switch, whereupon the light source illuminates the interior of the dishwashing machine; and a retractable button movable against a biasing means toward an actuation position in which the retractable button closes an electrical circuit to thereby energize the light source and a weight arranged relative to the retractable button such that the weight is operable under the influence of gravity to increasingly urge the retractable button against the biasing means toward the actuation position as the door is increasingly pivoted away from a vertical position.

7. The switch according to claim 6, and further comprising a strip-like bar having an end at which the weight is secured, the strip-like bar being arranged over the retractable button such that the weight presses the retractable button against the biasing means toward the actuation position as a result of gravity.

8. The switch according to claim 7, wherein the switch includes an unstably shaped connecting means guided through an eye-like recess in the retractable button, the weight being secured to an end of the unstably shaped connecting means such that the weight presses the retractable button against the biasing means toward the actuation position as a result of gravity.

9. The switch according to claim 8, wherein the unstably shaped connecting means is comprised of a selected one of wire, plastic, and wire and plastic.

10. A dishwashing machine, comprising:

a plurality of generally upstanding, interconnected interior walls forming a washing chamber;

a door pivotable around a horizontal axis thereof and movable between a closed position and an open position for accessing the washing chamber;

a door seal disposed intermediate the interior walls and the door to form a watertight washing compartment when the door is closed against the door seal;

a switch on the door that generates an electric signal when a predetermined pivoting angle of the door is reached as the door is being moved from the closed position to the open position; and a light source mounted to an interior surface of one of the interior walls and in the interior of the washing chamber, wherein the interior surface is interior of the door seal and not part of the door, wherein the light source is inside the watertight washing compartment formed when the door is closed against the door seal, and wherein the light source is electrically connected to the switch and illuminated in response to the electric signal received from the switch such that the light source illuminates the interior of the washing chamber of the dishwashing machine when the predetermined pivoting angle of the door is reached.

* * * * *

UNITED STATES PATENT AND TRADEMARK OFFICE

CERTIFICATE OF CORRECTION

PATENT NO. : 7,651,232 B2
APPLICATION NO. : 10/537131
DATED : January 26, 2010
INVENTOR(S) : Baumgartner et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 332 days.

Signed and Sealed this

Twenty-third Day of November, 2010

David J. Kappos

David J. Kappos
*Director of the United States Patent and Trademark Office*